US007963324B2

(12) United States Patent
Ohmer

(10) Patent No.: US 7,963,324 B2
(45) Date of Patent: Jun. 21, 2011

(54) FLOW CONTROL ACTUATION

(75) Inventor: Herve Ohmer, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 1534 days.

(21) Appl. No.: 10/904,910

(22) Filed: Dec. 3, 2004

(65) Prior Publication Data

US 2006/0118304 A1 Jun. 8, 2006

(51) Int. Cl.
*E21B 31/107* (2006.01)

(52) U.S. Cl. ..... 166/250.05; 166/177.1; 166/177.6; 166/178

(58) Field of Classification Search ..... 166/177.1, 166/177.2, 249, 178, 177.6, 177.7, 250.05
See application file for complete search history.

(56) References Cited

U.S. PATENT DOCUMENTS

| | | | | |
|---|---|---|---|---|
| 2,851,959 | A | 9/1958 | Kangas | |
| 4,418,766 | A * | 12/1983 | Grossmann | 173/13 |
| 4,624,306 | A * | 11/1986 | Traver et al. | 166/53 |
| 4,848,454 | A | 7/1989 | Spears | |
| 6,474,349 | B1 | 11/2002 | Laker | |
| 6,571,870 | B2 | 6/2003 | Zheng et al. | |
| 6,698,444 | B1 | 3/2004 | Enston | |
| 6,886,406 | B1 * | 5/2005 | Couet et al. | 73/579 |
| 2004/0055744 | A1 | 3/2004 | Zheng et al. | |

FOREIGN PATENT DOCUMENTS

| | | | |
|---|---|---|---|
| WO | WO 03/012250 | A1 | 2/2003 |
| WO | WO 03/019057 | A1 | 3/2003 |
| WO | WO2004/020263 | A1 | 3/2004 |

* cited by examiner

*Primary Examiner* — David J Bagnell
*Assistant Examiner* — David Andrews
(74) *Attorney, Agent, or Firm* — Brandon Clark; Rodney Warfford

(57) ABSTRACT

A method usable with a subterranean well that includes actuating a downhole tool (a valve assembly, for example). The method also includes applying at least one of an impulse stimulus and a vibration stimulus to the tool during the actuating to enhance operation of the tool.

8 Claims, 5 Drawing Sheets

FLOW CONTROL ACTUATION

BACKGROUND

The invention relates generally to flow control actuation.

A subterranean well typically includes flow control valves, such as sliding sleeve valves, ball valves and rotating sleeve valves, as just a few examples. The effective cross-sectional flow area of a flow control valve may be incrementally adjustable for purposes of precisely regulating the flow through the valve when open. Another type of flow control valve has a fixed cross-sectional flow area when open. Thus, this type of flow control valve is either fully closed or opened.

Regardless of the particular type of flow control valve, the static force that is required to actuate the valve (i.e., the static force needed to change the state of the valve) may increase over the lifetime of the valve, due to the deposition of solids (scale deposits, for example) on the valve. This deposition typically opposes the movement of parts (a sleeve, for example) of the flow control valve and thus, may require the use of more static force to operate the valve as the deposition accumulates over the life of the valve. A typical solution to this problem is to oversize (at least initially) the valve's actuator so that the actuator produces enough force to overcome an increasing opposing force as more material is deposited on the valve. However, this solution may cause the valve to be undesirably large, expensive and/or complex.

Thus, there exists a continuing need for an arrangement and/or technique to address one or more of the problems that are set forth above as well as possibly address one or more problems that are not set forth above.

SUMMARY

In an embodiment of the invention, a technique that is usable with a subterranean well includes actuating a downhole tool (a valve, for example) and applying at least one of an impulse stimulus and a vibration stimulus to the tool during the actuating to enhance operation of the tool.

In another embodiment of the invention, an apparatus that is usable with a subterranean well includes an actuator to apply a force to a downhole tool to operate the tool. The apparatus also includes a generator to apply at least one of an impulse stimulus and a vibration stimulus to the tool during the actuating to enhance operation of the tool.

Advantages and other features of the invention will become apparent from the following description, drawing and claims.

DETAILED DESCRIPTION

Figure 1:
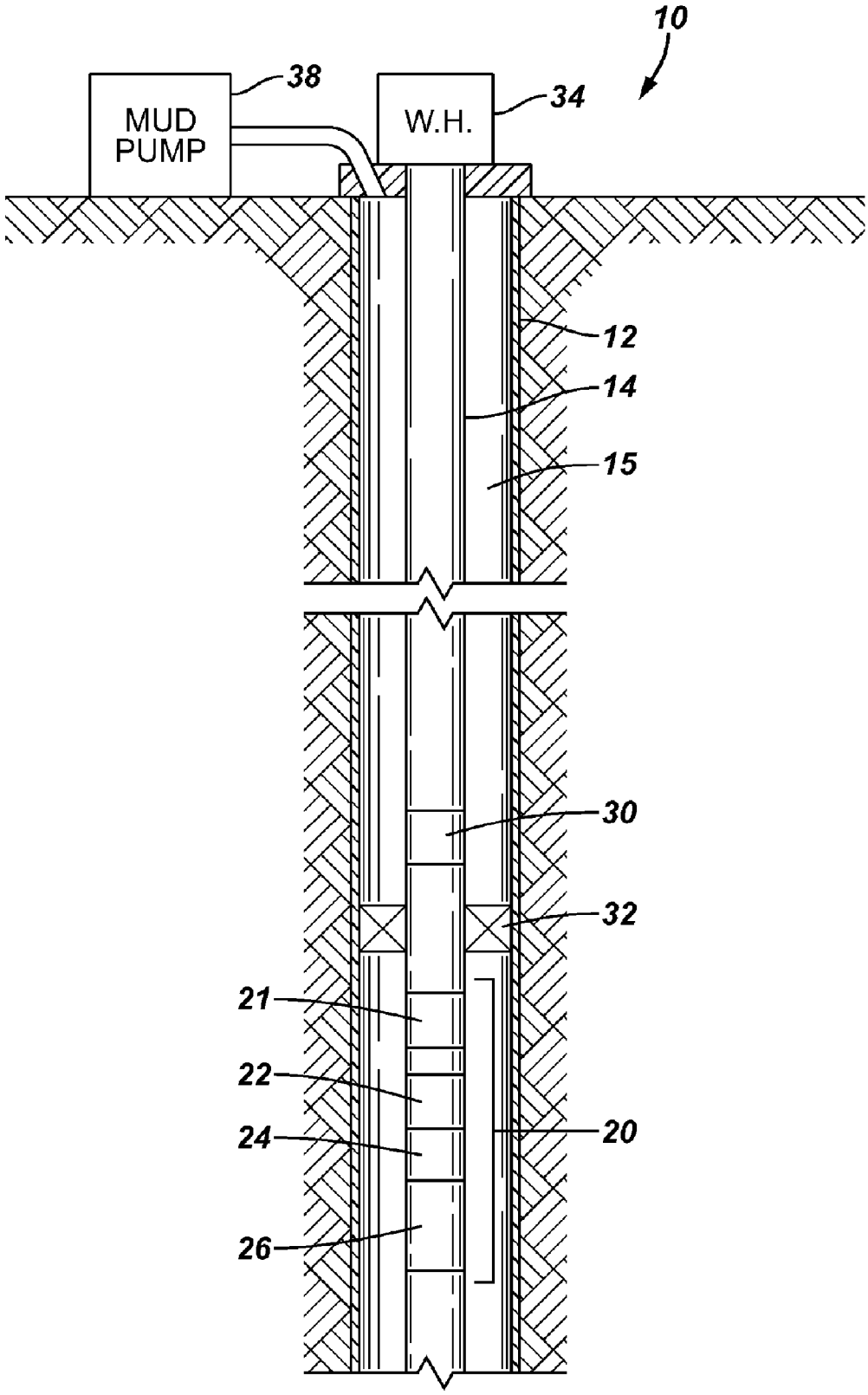
FIG. 1 is a schematic diagram of a well according to an embodiment of the invention.

Referring to FIG. 1, an embodiment of a well 10 in accordance with the invention includes a tubing string 14 (a production tubing string, for example) that extends into a vertical wellbore of the well 10. As shown in FIG. 1, in some embodiments of the invention, the well 10 may be cased, and thus, the tubing string 14 may extend through the passageway that is formed by a casing string 12 of the well 10. Alternatively, in some embodiments of the invention, the well 10 may be uncased, and thus, the tubing string 14 may extend through an uncased borehole of the well 10.

Although a vertical wellbore is depicted in FIG. 1, it is noted that in some embodiments of the invention, the tubing string 14, or a similar tubular string, may extend into a lateral wellbore, for example. Thus, many variations are possible and are within the scope of the appended claims.

The tubing string 14 includes a flow control valve assembly 20 (herein called "valve assembly 20"). As a specific example, it is assumed herein that the valve assembly 20 is a linear sliding sleeve valve. However, this is for purposes of example only, as in other embodiments of the invention, other types of valve assemblies may be used.

For example, the arrangements and techniques described herein may be applied to ball valves, rotating sleeve valves, incrementally-positionable valves, etc. Furthermore, as described below, in some embodiments of the invention, the valve assembly 20 may be an exterior sliding sleeve valve assembly, although in other embodiments of the invention, other types of sliding sleeve valves (an interior sliding sleeve valve, for example) may be used. Additionally, although FIG. 1 depicts a single valve assembly 20, it is understood that in other embodiments of the invention, the tubing string 14 may include multiple valve assemblies, each of which may be the same type of valve assembly or different types of valve assemblies (as examples). Furthermore, in some embodiments of the invention, the well 10 may include multiple tubing strings, in addition to the tubing string 14, for example.

In other embodiments of the invention, the well 10 may not include a tubular string 14, such as the tubing string that extends to the surface of the well (as depicted in FIG. 1), but rather, in some embodiments of the invention, a particular tubular section that contains a valve assembly that may be installed downhole and not extend to the surface of the well. Thus, many variations are possible and are within the scope of the appended claims.

Although techniques for actuating a valve assembly are described herein, it is understood that a valve assembly is just one example of a downhole tool. Thus, the techniques that are disclosed herein may be applied to other downhole tools, in other embodiments of the invention.

Referring to the specific embodiment that is depicted in FIG. 1, the valve assembly 20 may include an exterior sliding sleeve 26 that is operated (i.e., moved by) by a linear actuator 24 of the valve assembly 20 for purposes of opening and closing the valve assembly 20 to the flow of well fluid. For example, the sliding sleeve valve 26 may control communication between an annulus 15 of the well 10 and a central passageway of the tubing string 14. Here, the phrase "annulus" means the region between the outside of the tubing string 14 and the interior surface of the casing string 12.

It is noted that in some embodiments of the invention, the valve assembly 20 may be incrementally-adjustable, in that the sleeve 26 may be controlled to vary the size of the effective cross-sectional area flow path of the valve assembly 20 when the valve assembly 20 is not closed. This particular embodiment is described below. However, in other embodiments of the invention, the valve actuator 20 may operate the sleeve 26 so that the valve assembly 20 is either fully opened or closed (i.e., the valve assembly may have a cross-sectional area flow path whose size is not incrementally-adjustable).

Over the course of the lifetime of the valve assembly 20, deposits may accumulate on the surface over which the sleeve 26 moves and introduce resistance to the movement of the sleeve 26. For example, it is possible that over the course of the lifetime of the valve assembly 20, scale deposit may build up on the surface over which the sleeve 26 slides. As a result, the scale deposit may significantly resist movement of the sleeve 26 so that the sleeve 26 may not receive enough force (via the linear actuator 24) to operate (i.e., move to the desired position), if not for the features of the present invention. To accommodate this scenario, a conventional valve assembly may oversize the linear actuator which means the actuator is designed to exert enough force to accommodate a future scale (or other deposit) build up on the valve assembly 20, which opposes movement of the sliding sleeve. However, unlike conventional arrangements, in some embodiments of the invention, the linear actuator 24 is not oversized in anticipation of deposit buildup on the valve assembly 20. Rather, in some embodiments of the invention, the valve assembly 20 applies impulse and/or vibrational energy concurrently with the operation of the valve assembly 20 for purposes of overcoming any opposing forces (to the sleeve's movement) that are caused by deposition of solids on the valve assembly 20.

More specifically, in some embodiments of the invention, the valve assembly 20 includes an impulse/vibration generator 22, a mechanical and/or electrical device that is actuated during operation of the valve assembly 20 for purposes of producing an impulse stimulus and/or a vibration stimulus that is superimposed on the output force that is generated by the actuator 24 to overcome any scale or other deposit that would otherwise oppose the displacement of the sleeve 24. In this notation, the "impulse/vibration generator" means either an impulse generator that generates an impulse stimulus; a vibration generator that generates a vibration stimulus; or a combined impulse and vibration generator that generates both impulse and vibration stimuli.

It is noted that the generator 22 may be actuated both during the opening of the sleeve 26 in a particular direction and also during the closing of the sleeve 26 in the opposite direction.

In the context of this application, a vibration stimulus is a stimulus (of a long or short duration) that is somewhat periodic in nature in that the vibration stimulus has a frequency that is constant or follows a predefined sweep pattern. The amplitude and frequency of the vibration stimulus is chosen to overcome the resistance to the intended movement of the downhole tool. Thus, the generator 22, in some embodiments of the invention, generates the vibration stimulus until the resistance to movement is overcome. The vibration stimulus is to be contrasted to the impulse stimulus, a stimulus that may be unique or repeated without a predetermined timing. In some embodiments of the invention, the generator 22 repeats generation of the impulse stimulus after a certain lapse in time only if the resistance remains, with the frequency at which generator 22 repeats the impulses not being instrumental in overcoming the resistance.

Depending on the particular embodiment of the invention, the generator 22 may generate a vibration stimulus only, impulse stimuli only or a combination of the two. Thus, for example, in some embodiments of the invention, the generator 22 may generate a vibration stimulus and at non-regular intervals generate impulse stimuli (superimposed upon the vibration stimulus) until the resistance to the sleeve's movement is overcome. Therefore, many variations are possible and are within the scope of the appended claims.

Still referring to FIG. 1, among the other features of the well 10, in some embodiments of the invention, the well 10 may include, for example, a wellhead 34 that is connected to the surface of the tubing string 14 for purposes of (for example) directing production fluid from the string 14 to a pipeline or well fluid processing equipment. Furthermore, in some embodiments of the invention, the well 10 may include, for example, a mud pump 38 that is connected to an annulus 15 of the well.

The mud pump 38 may be controlled to, for example, communicate command-encoded fluid pulses through the annulus 15 for purposes of operating the valve assembly 20. In this regard, in some embodiments of the invention, the tubing string 14 may include, for example, a fluid pressure sensor 30 that is in communication with the annulus 15 for purposes of detecting fluid pressure exerted by the mud pump 38 on the fluid in the annulus. Electronics 21 of the valve assembly 20 use the fluid pressure sensor 30 to extract encoded commands from the fluid and operate the valve assembly 20 accordingly. As depicted in FIG. 1, in some embodiments of the invention, a packer 32 may seal off the annulus 15 near (above, for example) the valve assembly 20.

Other variations are possible in other embodiments of the invention. For example, many other techniques may be used to communicate with and control the valve assembly 20 in other embodiments of the invention. In this regard, acoustic, and/or electromagnetic communication may be used in other embodiments of the invention to communicate commands to the valve assembly 20 from the surface. Furthermore, in other embodiments of the invention, the central passageway of the tubing string 14 may be used, for example, to communicate command-encoded fluid pulses to the valve assembly 20. Thus, many variations are possible and are within the scope of the appended claims.

Figure 2:
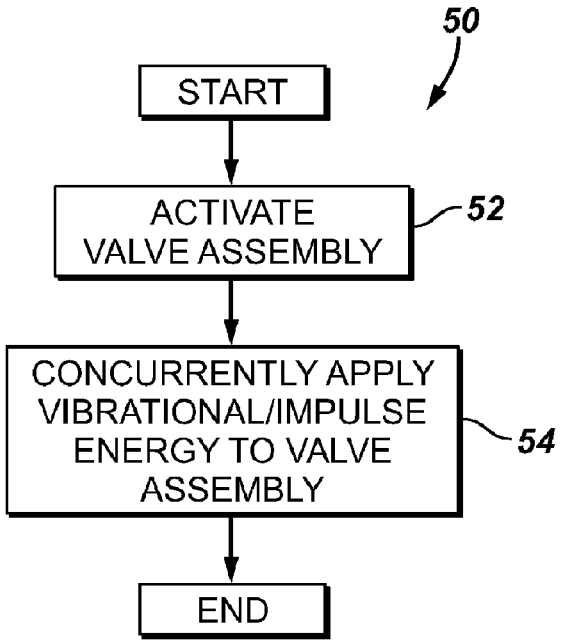
FIGS. 2 and 9 are flow diagrams depicting techniques to actuate a flow control valve assembly according to embodiments of the invention.

Referring to FIG. 2, in accordance with some embodiments of the invention, a technique 50 may be used for purposes of operating the valve assembly 20. Pursuant to the technique 50, the valve assembly 20 is actuated, as depicted in block 52. More specifically, in accordance with some embodiments of the invention, the actuation of the valve assembly 20 may include, for example, communicating a command downhole to the valve assembly 20 for purposes of changing the cross-sectional flow path (i.e., either decreasing the cross-sectional flow path, increasing the cross-sectional flow path or closing off the cross-sectional flow path.) Regardless of the specific command, the actuation of the valve 52 means that the actuator 24 (see FIG. 1) moves the sleeve 26 (see FIG. 1) in a particular direction. Still referring to FIG. 2, pursuant to the technique 50, impulse stimuli and/or a vibration stimulus is concurrently applied to the valve assembly 20, during the actuation, to impart vibrational/impulse energy to the valve assembly, as depicted in block 54. Thus, the technique 50 superimposes vibrational and/or impulse forces with the force that is exerted by the linear actuator 24 for purposes of moving the sleeve 26 in a particular direction to increase or restrict flow through the valve assembly 20.

Figure 3:
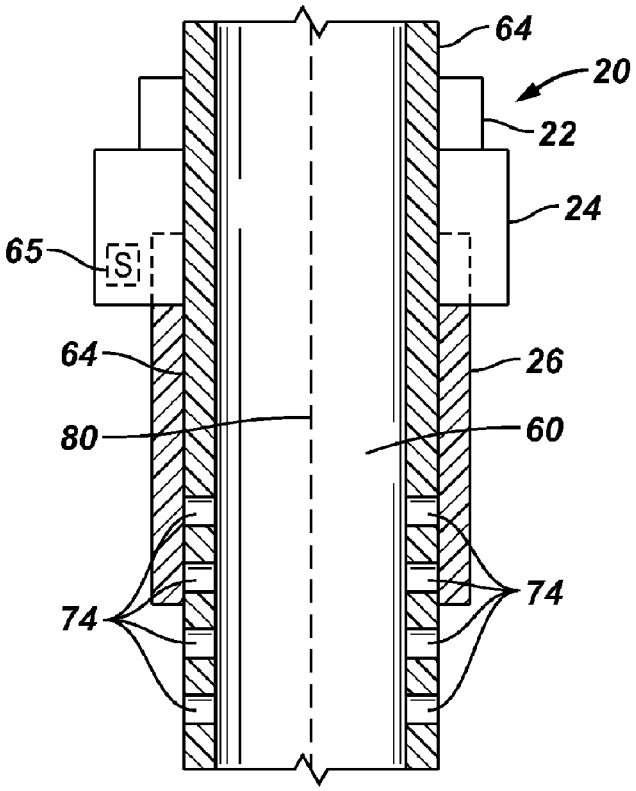
FIGS. 3 and 4 are schematic diagrams of flow control valve assemblies according to embodiments of the invention.

As a more specific example, FIG. 3 depicts an embodiment of the valve assembly 20 in accordance with the invention. As shown, in some embodiments of the invention, the valve assembly 20 includes the linear actuator 24 and the generator 22 that may be mounted to, for example, a wall 64 of the tubing string 14.

As depicted in FIG. 3, in some embodiments of the invention, the generator 22 may be coupled to the wall 64 to apply the impulse/vibrational energy directly to the tubing string 14, as the string 14 may be used as a guide to communicate the impulse/vibrational energy to the sliding sleeve 26. However, as further described below, impulse/vibrational energy may be applied to the sleeve 26 by other techniques, in other embodiments of the invention.

As depicted in FIG. 3, in some embodiments of the invention, radial ports 74 extend through the wall 64. When the sleeve 26 is in its very upmost position (a position not depicted in FIG. 3), the valve assembly 20 is fully opened to its least restrictive effective cross-sectional flow path. However, the sliding sleeve 26 may be moved to other positions in which some of the radial ports 74 are blocked by the sleeve 26 and other radial ports 74 are open to allow flow into a central passageway 60 of the tubing string 14. Thus, the effective flow path through the valve assembly 20 depends on the particular position of the sleeve 26.

As also depicted in FIG. 3, in some embodiments of the invention, the linear actuator 24 may include a torque and/or force sensor 65 that measures the force/torque that is being applied to the sleeve 26 by the linear actuator 24. As described further below, by measuring the force that is exerted on the sliding sleeve 26, a decision may be made (automatically by electronics of the valve assembly 20 or remotely by an operator at the surface of the well, as examples) whether or not to actuate the generator 22 to cause the generator 22 to generate impulse stimuli and/or a vibration stimulus. The decision on what type of stimulis (vibration, impulse or a combination of the two) may be based on the measured force, in some embodiments of the invention.

In some embodiments of the invention, the generator 22 may be continuously on; and in other embodiments of the invention, the generator 22 may be activated only when movement of the sliding sleeve 26 is required and thus, may only be activated when the linear actuator 24 itself is actuated. Thus, many variations are possible and are within the scope of the appended claims.

Figure 4:
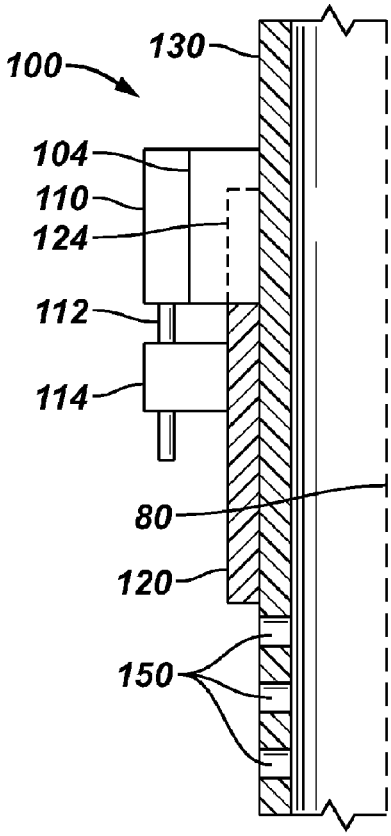

Referring to FIG. 4, in some embodiments of the invention, a valve assembly 100 may be used. It is noted that only one half of the valve assembly 100 is depicted and it is understood that the other half of the valve assembly 100 appears on the other side of a longitudinal axis 80 of the valve assembly 100. The valve assembly 100 includes an internal tubular member 130 that is concentric with the longitudinal axis 80 and is concentric with the portions of the tubular string immediately above and below the valve assembly 100. The inner tubular member 130 includes radial ports 150 that are selectively opened and closed by a sliding outer sleeve 120.

As depicted in FIG. 4, in some embodiments of the invention, the valve assembly 100 includes an impulse/vibration generator 104 that is coupled to the inner tubular member 130 and receives an upper end 124 of the outer sliding sleeve 120. Thus, in these embodiments of the invention, the generator 104 may directly apply a vibration stimulus or impulse stimuli to the sliding sleeve 120. As also depicted in FIG. 4, a linear actuator 110 may be coupled to the inner tubular member 130, via the generator 104, or may be directly coupled to the inner tubular member 130, depending on the particular embodiment of the invention.

The linear actuator 110 includes a shaft 112 that moves upwardly and downwardly in response to the desired position of the sliding sleeve 120. As shown in FIG. 4, in some embodiments of the invention, the shaft 112 may be connected via a coupler 114 to the outer sleeve 120. Thus, due to the arrangement shown in FIG. 4, when restriction of flow through the valve assembly 100 is desired, the linear actuator 110 is controlled to extend the shaft 112 and move the sleeve 120 in a downward direction. Conversely, when it is desired to increase the cross-sectional view path through the valve assembly 100, the linear actuator 110 is operated to retract the shaft 112 to move the sleeve 120 in an upwardly direction. In the state that is depicted in FIG. 4, the valve assembly 100 is in its fully open position.

Figure 5:
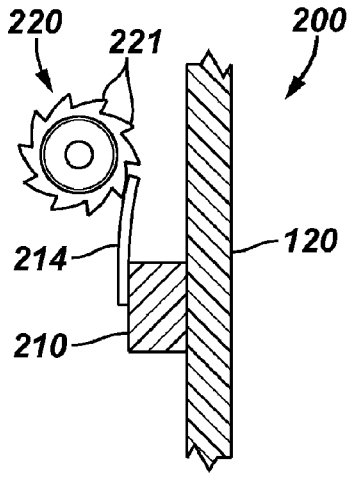
FIGS. 5, 6 and 7 are schematic diagrams of impulse/vibration generators according to different embodiments of the invention.

The impulse/vibration generator may take on various forms, depending on the particular embodiment of the invention. For example, referring to FIG. 5, in some embodiments of the invention, an impulse/vibration generator 200 may include a ratchet wheel 220 that includes ratchet teeth 221. When vibrational force is to be applied to the valve assembly, the ratchet wheel 220 moves. As shown in FIG. 5, a flexible member 214 (a spring, for example) is positioned to be deflected by the ratchet teeth 221, as the ratchet wheel 220 rotates (rotates in a clockwise direction, for example).

The end of the member 214 that is near the ratchet teeth 221 is fixed to a coupling member 210 that couples the member 214 to the sleeve 120 (see FIG. 3). Thus, as the ratchet wheel 220 turns, each ratchet tooth 221 deflects the member 214 to transfer energy to the sleeve 120.

As a more specific example, continuous rotation (for some duration) of the ratchet wheel 220 causes the ratchet teeth 221 to strike the flexible member 214 at some frequency (constant or sweep) to generate a vibration impulse. In some embodiments of the invention, an impulse stimulus may be generating by turning the ratchet wheel 220 to cause a single ratchet tool 221 to strike the flexible member.

When it is no longer desired to apply vibration and/or impulse stimuli to the sleeve 120, rotation of the ratchet wheel 220 is halted. Thus, in some embodiments of the invention, the generator 200 may include a motor (not shown in FIG. 5) to turn the ratchet wheel 220 as described above to selectively generate the impulse/vibrational energy. As a few examples, operation of this motor may be performed automatically by downhole electronics (in response to sense a force exerted by the sleeve's actuator or always when movement of the sleeve is desired, as examples) or may be remotely operated from the surface of the well, depending on the particular embodiment of the invention.

Figure 6:
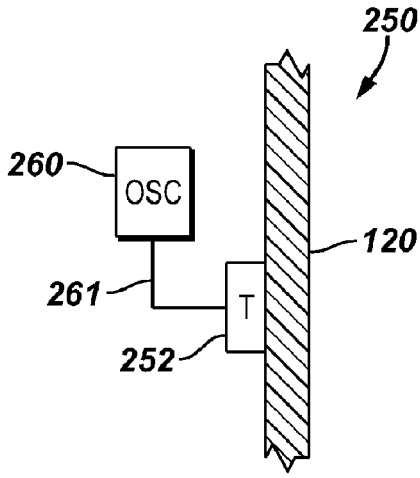

In another embodiment of the invention, a vibration generator 250 may have the form that is depicted in FIG. 6. In this embodiment of the invention, the generator 250 includes an ultrasonic transducer 252 that is coupled to the sleeve 120. The transducer 252, in turn, communicates (via one or more communication lines 261) to an oscillator 260. When activation of the generator 250 is desired, the oscillator 260 is enabled to allow an oscillating electrical signal to be communicated (via the communication line(s) 261) to the transducer 252. In response to the oscillating signal, the transducer 252 produces ultrasonic waves that propagate through the sliding sleeve 120. The oscillator 260 is disabled, in some embodiments of the invention, when it is desired that the impulse generator 250 no longer applies vibrational energy to the valve assembly.

In another embodiment of the invention, an impulse generating circuit may be coupled to the transducer 252 (in replacement or as a supplement to the oscillator 260) to provide (when actuated) an electrical impulse signal to the transducer 252 to cause the transducer 252 to produce an ultrasonic impulse stimulus that travels to the sleeve.

Figure 7:
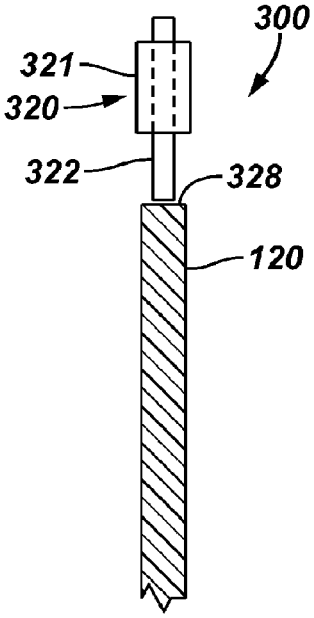

As yet another example of embodiment of the invention, in some embodiments of the invention, an impulse/vibration generator 300 that is depicted in FIG. 7 may be used. The generator 300 includes a solenoid 320 that includes a main body 321. The main body 321 includes a coil (not shown in FIG. 7) that defines a central passageway through which a solenoid shaft 322 extends. The solenoid 320 may be electrically activated to control movement of the shaft 322. As depicted in FIG. 7, the shaft 322 may be extended by the solenoid 320 to strike an upper surface 328 of the sleeve 120.

Thus, when vibrational energy is to be applied to the sleeve 120, the solenoid 320 may be actuated to move the shaft 322 to strike the surface 328 to introduce vibration and/or impulse stimuli to the sleeve 120. In some embodiments of the invention, the solenoid 320 may be connected to, for example, an oscillator that is enabled to cause the solenoid 320 to transfer vibrational energy is to be applied to the valve assembly. More specifically, when vibrational energy is to be applied, the oscillator is enabled to cause the linear movement of the shaft 322 to oscillate between upward and downward positions, thereby continually striking the surface 328 to communicate a vibration stimulus to the sleeve 120. When vibrational energy is no longer to be applied to the sleeve 120, the oscillator may then be disabled. The solenoid 320 may also be operated in a non-periodic manner to apply impulse stimuli to the sleeve 120.

Figure 8:
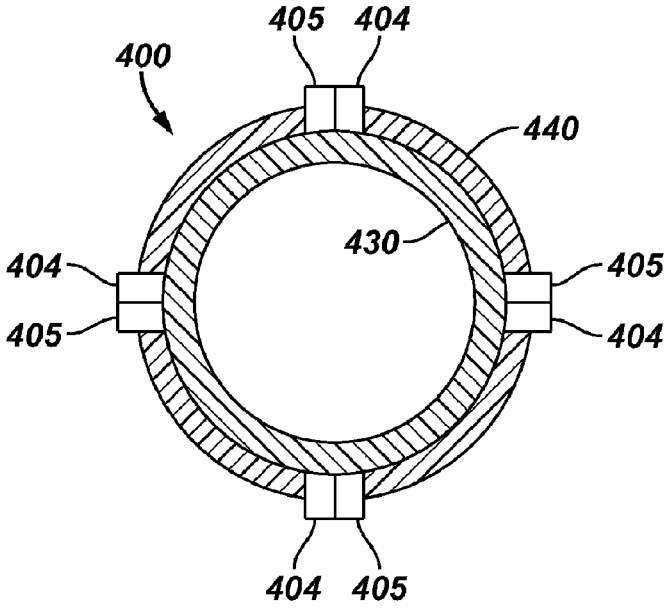
FIG. 8 is a cross-sectional view of a flow control valve assembly according to an embodiment of the invention.

In some embodiments of the invention, the valve assembly may include multiple linear actuators to move the sleeve. This arrangement balances the forces that are applied to the sliding sleeve and provides the valve with mechanical redundancy. For these embodiments of the invention, impulse/vibration generators may be distributed around the outer periphery of the valve assembly equally spaced from the longitudinal axis of the valve assembly. As a more specific example, FIG. 8 depicts a cross-sectional view of a valve assembly 400 in accordance with an embodiment of the invention. The cross-section depicted in FIG. 8 is taken along the cross-section that extends through the tubing string (such as the tubing string 14 (FIG. 1)) so that, as depicted in FIG. 8, an inner tubular member 430 that is concentric with the tubing string is surrounded by an outer sliding sleeve 440. Instead of only having one linear actuator and impulse/vibration generator pair, the valve assembly 400 includes multiple pairs of linear actuators and impulse/vibration generators.

For example, as depicted in FIG. 8, in some embodiments of the invention, the valve assembly 400 may include four pairs of linear actuators 404 and impulse/vibration generators 405. These pairs may extend around the periphery of the sliding sleeve 440 to distribute the forces provided to the sleeve 440 as well as provide mechanical redundancy should one of the generators 405 or linear actuators 404 fail.

In some embodiments of the invention, the impulse/vibration generator is continuously active whenever the linear actuator (i.e., the sliding sleeve's actuator) is turned on. However, in some embodiments of the invention, the impulse/vibration generator may be triggered on, or actuated, when a certain threshold of a force and/or torque is reached. More specifically, referring to FIG. 9, in some embodiments of the invention, a technique 500 may be used to operate the valve assembly for purposes of transitioning the sliding sleeve from one position to another position.

Pursuant to the technique 500, the actuation of the valve assembly begins, as depicted in block 502. Next, a determination is made (diamond 504) whether a force/torque threshold is exceeded. In this regard, in some embodiments of the invention, the valve assembly may include a torque or force sensor, such as the sensor 65 that is depicted in FIG. 3, for example. The sensor measures the amount of force/torque that the linear actuator applies to the sliding sleeve. If, pursuant to the technique 500, a determination (diamond 504) is made that the force/torque threshold is exceeded, then vibrational/impulse energy is applied to the valve assembly, as depicted in block 506.

If a determination (diamond 504) is made that the force/torque threshold has not been exceeded, then a determination (diamond 508) is made whether the valve has reached its final position. If not, actuation of the valve assembly is continued (block 510) and control returns to diamond 504. If the valve has reached its final position (diamond 508) then the technique 500 ends. It is noted that after the energy is applied to the valve assembly in block 506, control transitions to diamond 508.

Other embodiments are within the scope of the appended claims. For example, in some embodiments of the invention, the impulse/vibration generator(s) may be independently controlled from the surface of the well. Thus, in these embodiments of the invention, an operator at the surface of the well may communicate command-encoded stimuli downhole for purposes of controlling the valve assembly. Depending on a variety of potential factors (a downhole sensor indicates the linear actuator is exerting a large amount of force on the sleeve, the time that the valve has been installed downhole (and thus, more susceptible to heavier deposits), indications (from downhole sensors, etc.) that the valve assembly is not behaving properly, etc.), the operator at the surface may then communicate other command-encoded stimuli downhole for purposes of independently controlling the impulse/vibration generator(s) to superimpose additional energy to operate the valve assembly.

Figure 9:
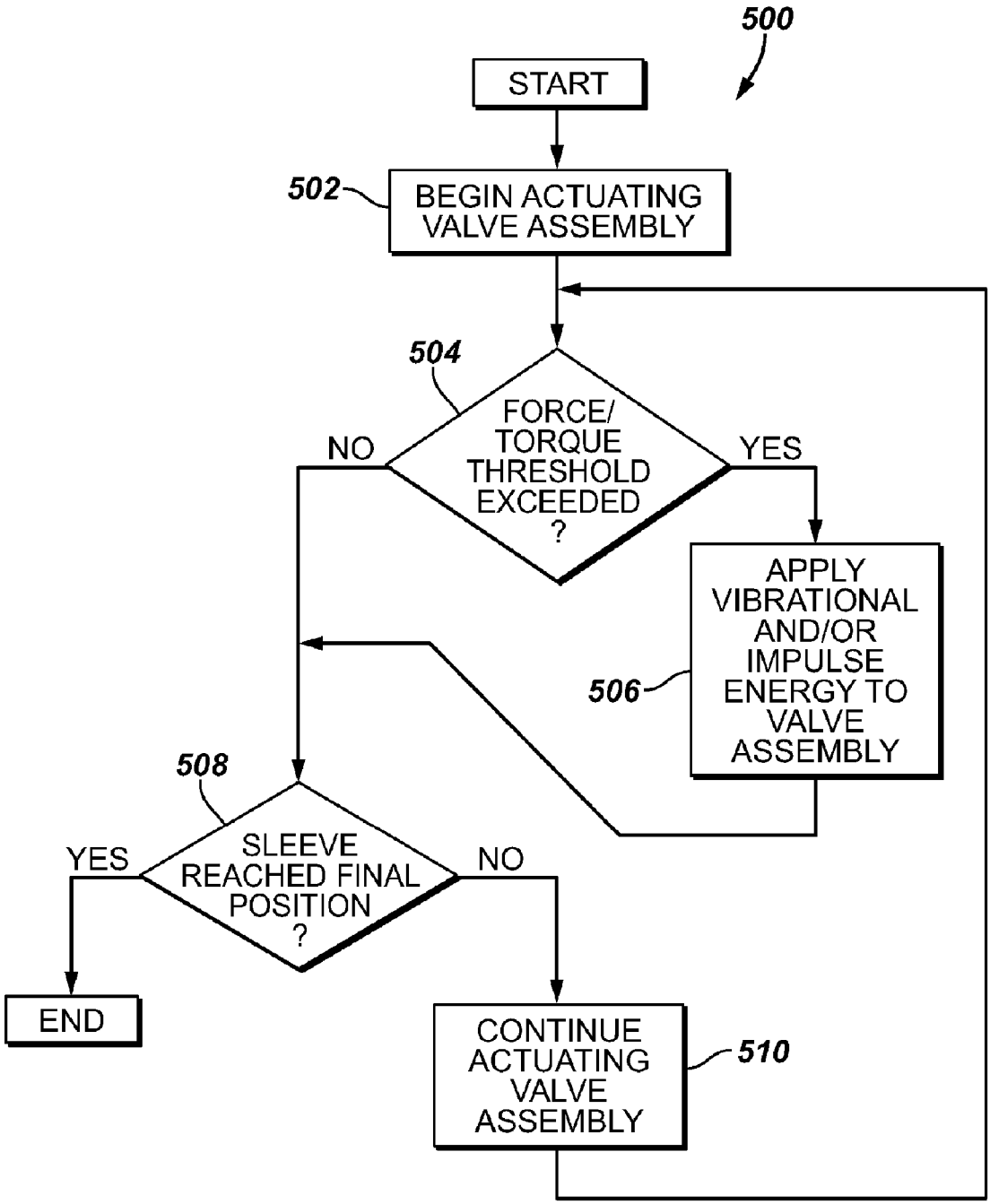
Figure 10:
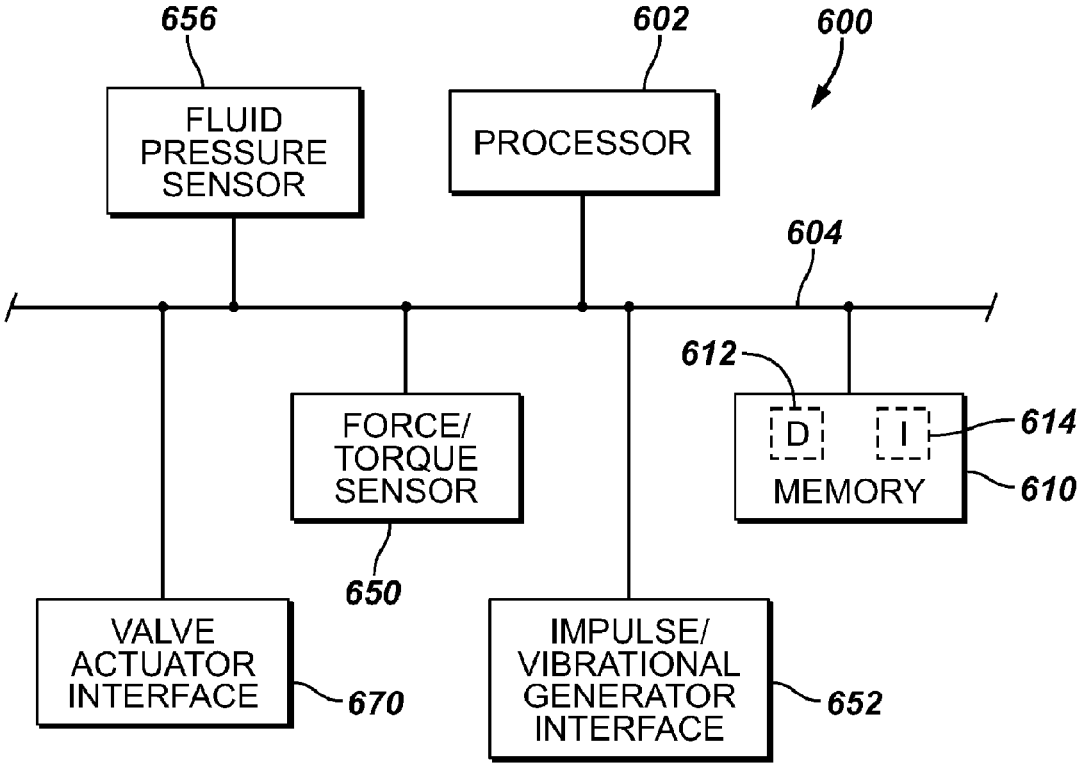
FIG. 10 is a schematic diagram of electronics of the flow control valve assembly according to an embodiment of the invention.

Electronics 600 of the valve assembly may have a general form that is depicted in FIG. 10, in some embodiments of the invention. The electronics 600 includes a processor 602 (representative of one or more microprocessors or microcontrollers, for example) that is coupled to a system bus 604. The electronics 600 also includes a memory 610 that is coupled to the system bus 604 and is accessible by the processor 602. The memory 610 stores, for example, data 612 collected from sensors as well as possibly commands decoded by the electronics 600 for operation of the valve assembly. The memory 610 may also store, for example, instructions 614 to cause the valve assembly to perform one or more of the techniques that are disclosed herein. For example, in some embodiments of the invention, the instructions 614 may cause the processor 602 to control the valve assembly pursuant to the technique 500 (FIG. 9). The electronics 600 may also include an impulse/vibration generator interface 652 for purposes of controlling the impulse/vibration generator.

Among its other features, the electronics 600 may also include, for example, a force/torque sensor 650 (to serve the torque and/or other force that the actuator applies to the sliding sleeve), a valve actuator interface 670 (controlling the linear actuator) and a fluid pressure sensor 656 (for purposes of decoded command-encoded fluid pulses that propagate through the annulus, for example), all of which are coupled to the processor 602 via the system bus 604.

The electronics 600 depicted in FIG. 10 is merely an example of one of many possible embodiments for the electronics of the valve assembly. Thus, other embodiments are possible and are within the scope of the appended claims.

While the present invention has been described with respect to a limited number of embodiments, those skilled in the art, having the benefit of this disclosure, may appreciate numerous modifications and variations therefrom. It is intended that the appended claims cover all such modifications and variations as fall within the true spirit and scope of this present invention.

What is claimed is:

1. A method usable with a well, comprising:

actuating a downhole tool;

applying a stimulus selected from a group consisting of an impulse stimulus and a vibration stimulus to the tool during the actuating to enhance operation of the tool;

measuring a force associated with actuating the tool; and selectively applying the stimulus selected from the group in response to the measurement.

2. The method of claim 1, wherein the force comprises a torque.

3. A method usable with a well, comprising:

operating an actuator to apply a force to a valve assembly to change the size of a flow path through the valve assembly;

in response to the operation of the actuator, applying a stimulus selected from a group consisting of an impulse stimulus and a vibration stimulus to the valve assembly;

measuring the force; and selectively applying the stimulus selected from the group in response to the measurement.

4. The method of claim 3, wherein the force comprises a torque.

5. An apparatus usable with a well, comprising:

an actuator to apply a force to a downhole tool to operate the tool; and a generator to apply a stimulus selected from a group consisting of an impulse stimulus and a vibration stimulus to the tool during the application of force by the actuator to enhance operation of the tool, wherein the generator is adapted to selectively generate the stimulus selected from the group and vibration stimulus in response to the measurement.

6. The apparatus of claim 5, wherein the force comprises a torque.

7. An apparatus usable with a well, comprising:

an actuator to apply a force to a valve assembly to change the size of a flow path through the valve assembly;

a generator to, in response to the operation of the actuator, apply energy to the valve assembly; and a sensor to measure the force, wherein the generator is adapted to selectively apply the energy in response to the measurement.

8. The apparatus of claim 7, wherein the force comprises a torque.

* * * * *